US007311077B2

(12) United States Patent
Driver

(10) Patent No.: US 7,311,077 B2
(45) Date of Patent: Dec. 25, 2007

(54) ROTARY POSITIVE DISPLACEMENT MACHINE WITH ORBITING PISTON

(75) Inventor: Ronald William Driver, Lancashire (GB)

(73) Assignee: E.A. Technical Services Ltd., Chatburn, Lancashire (GB)

( * ) Notice: Subject to any disclaimer, the term of this patent is extended or adjusted under 35 U.S.C. 154(b) by 271 days.

(21) Appl. No.: 10/529,910

(22) PCT Filed: Oct. 1, 2003

(86) PCT No.: PCT/GB03/04240

§ 371 (c)(1),
(2), (4) Date: Apr. 1, 2005

(87) PCT Pub. No.: WO2004/031539

PCT Pub. Date: Apr. 15, 2004

(65) Prior Publication Data

US 2006/0090465 A1 May 4, 2006

(30) Foreign Application Priority Data

Oct. 2, 2002 (GB) ..... 0222770.0
May 13, 2003 (GB) ..... 0310889.1
Sep. 8, 2003 (GB) ..... 0320919.4

(51) Int. Cl.
*F02B 53/04* (2006.01)
*F01C 1/46* (2006.01)
*F01C 1/00* (2006.01)
*F04C 18/00* (2006.01)

(52) U.S. Cl. ..... 123/237; 123/229; 123/226; 418/248

(58) Field of Classification Search ..... 123/234–237; 418/243, 247–249, 141, 183
See application file for complete search history.

(56) References Cited

U.S. PATENT DOCUMENTS 773,649 A * 11/1904 Krueger ..... 418/248
1,320,953 A * 11/1919 Winn ..... 123/237
3,693,600 A * 9/1972 Nutku ..... 123/226
3,839,995 A 10/1974 Williams ..... 123/234
3,938,478 A * 2/1976 Piper ..... 123/229
4,047,857 A 9/1977 Fischer ..... 418/153

(Continued)

FOREIGN PATENT DOCUMENTS

CH 334058 11/1958

(Continued)

*Primary Examiner*—Thai-Ba Trieu
(74) *Attorney, Agent, or Firm*—Baker & Hostetler LLP

(57) ABSTRACT

A casing has a circular cylindrical internal surface delimiting an operating chamber. An orbiting piston is mounted so as to orbit about a chamber axis which is the axis of the internal surface. The orbiting piston has a circular cylindrical external surface, a generatrix of the external surface being adjacent to the said internal surface, and a diametrically opposite generatrix spaced form the internal surface. A vane member has a tip face which faces the external surface of the orbiting piston and which has a length substantially equal to that of the orbiting piston. A linkage connects the vane member to the orbiting piston to keep the tip face adjacent the external surface. At least one of the external and internal surfaces has individual compliant strips distributed around the one surface, which run parallel to one another, and project above the one surface.

15 Claims, 5 Drawing Sheets

U.S. PATENT DOCUMENTS 4,657,009 A * 4/1987 Zen ..... 123/237

FOREIGN PATENT DOCUMENTS

| | | | | |
|---|---|---|---|---|
| DE | 488069 | | | 12/1929 |
| DE | 4427105 | C1 | * | 1/1996 |
| FR | 500243 | | | 3/1920 |
| FR | 22789223 | | | 2/1976 |
| GB | 207921 | | | 12/1923 |
| GB | 2122686 | | * | 1/1984 |
| JP | 55093902 | A | * | 7/1980 |
| WO | WO 02/04787 | A2 | | 1/2002 |
| WO | WO 2003012259 | A1 | * | 2/2003 |
| WO | WO 03/062604 | A3 | | 7/2003 |

* cited by examiner

ROTARY POSITIVE DISPLACEMENT MACHINE WITH ORBITING PISTON

CROSS REFERENCE TO RELATED APPLICATIONS

This application claims priority to Patent Cooperation Treaty (PCT) Application No. PCT/GB2003/004240 filed on Oct. 1, 2003 entitled, Rotary Positive Displacement Machine with Orbiting Piston, which claims priority to United Kingdom Patent Applications Serial Nos. 0222770.0, filed Oct. 2, 2002; 0310889.1 filed May 13, 2003; and 0320919.4 filed Sep. 8, 2003; all of the above disclosures are herein incorporated by reference in their entirety.

FIELD OF THE INVENTION

This invention relates to rotary positive displacement machines, in particular of the type having an orbiting piston.

WO 03/062604 describes orbiting piston compressors and expanders. One machine can act as a compressor while another can act simultaneously as a turbine providing expansion, or two machines can both act simultaneously as compressors or as turbines. Two machines can be fitted together so that out-of-balance forces oppose each other.

Such machines may operate over a wide speed range. With a given running clearance and pressure ratio, fluid leakage is a higher percentage of total fluid flow at low speed than at high speed. Leakage can be reduced by resorting to smaller manufacturing tolerances, but with the disadvantage of increased manufacturing cost.

BACKGROUND OF THE INVENTION

The present invention provides a rotary positive displacement machine comprising:

a casing having a circular cylindrical internal surface delimiting an operating chamber;

an orbiting piston in the operating chamber, the orbiting piston being mounted so as to orbit about a chamber axis which is the axis of the said internal surface, the orbiting piston having a circular cylindrical external surface, the chamber axis passing through the orbiting piston, a generatrix of the external surface being adjacent to the said internal surface, and a diametrically opposite generatrix being spaced from the said internal surface;

a vane member mounted on the casing, the vane member having a tip face which faces the external surface of the orbiting piston and which has a length substantially equal to that of the orbiting piston; and a linkage which connects the vane member to the orbiting piston so as to keep the tip face of the vane member adjacent the external surface of the orbiting piston.

In one aspect the invention provides a machine wherein at least one of the said external and internal surfaces is provided with individual compliant strips which are distributed around the said one surface, run parallel to one another, and project above the said one surface.

SUMMARY OF THE INVENTION

In another aspect the invention provides a machine wherein the orbiting piston comprises an extruded body.

BRIEF DESCRIPTION OF THE DRAWINGS

The invention will be described further, by way of example only, with reference to the accompanying drawings, in which.

DETAILED DESCRIPTION

Figure 1:
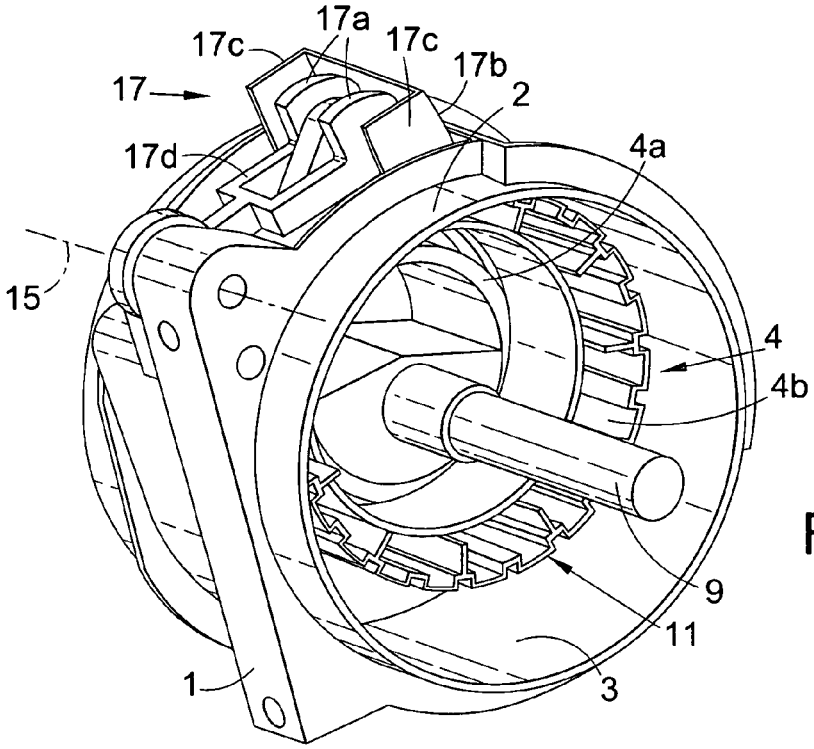
FIG. 1 is a perspective view of a rotary positive displacement machine, with parts omitted.
Figure 2:
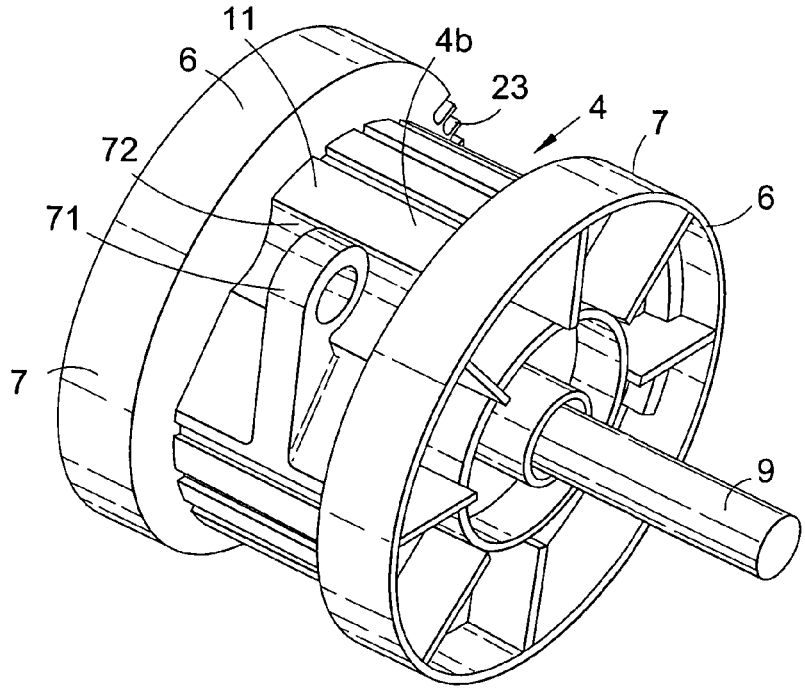
FIG. 2 is a perspective view of an orbiting piston and rotating side discs of the machine shown in FIG. 1.
Figure 3:
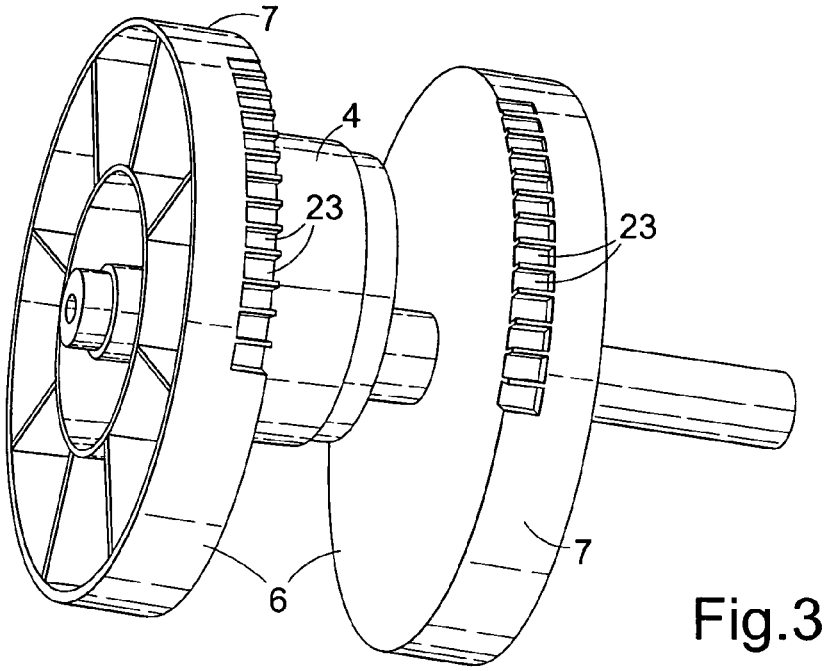
FIG. 3 is a perspective view of the side discs and the rotating inner part of the orbiting piston.

The type of rotary positive displacement machine which is shown in FIGS. 1 to 3 is more fully described in WO 03/062604. It comprises a casing 1 with a peripheral wall 2 having a circular cylindrical internal surface 3. An orbiting piston 4 (also referred to as a rolling piston) comprises a rotating inner part 4*a*, eccentrically mounted on an input/output drive shaft 9 and carrying at each end a shutter in the form of a flange or disc 6, and a non-rotating outer part 4*b* which orbits about the axis of the internal surface 3. The outer part 4*b* of the orbiting piston 4 has a circular cylindrical external surface 11, one generatrix is spaced from the internal surface 3.

A vane member 17 is accommodated in an aperture in the casing 1 and this aperture can function as a fluid inlet/outlet. The vane member 17 has passageways 17*a* communicating between the exterior of the casing 1 and the operating chamber, an arcuate end wall 17*b*, transverse walls 17*c* extending from the respective ends of the end wall 17*b*, a forked arm 17*d* which is pivotally mounted on the casing 1 (pivot axis 15), and a tip face (not visible) which is a sealing surface with respect to a recess 72 in the external surface 11 of the orbiting piston 4. A fixed appendage 71 to the outer part 4*b* is connected to the arm 17*d* by a bearing (not visible) at a position between the pivot axis 15 of the vane member 17 and its arcuate end wall 17*b*.

Each end disc 6 has a circular cylindrical periphery 7 with only a small clearance between itself and the internal surface 3 of the casing 1. Each disc 6 has fluid inlet/outlet passages 23 for communicating between the operating chamber and openings (not shown) in the casing.

Figure 4:
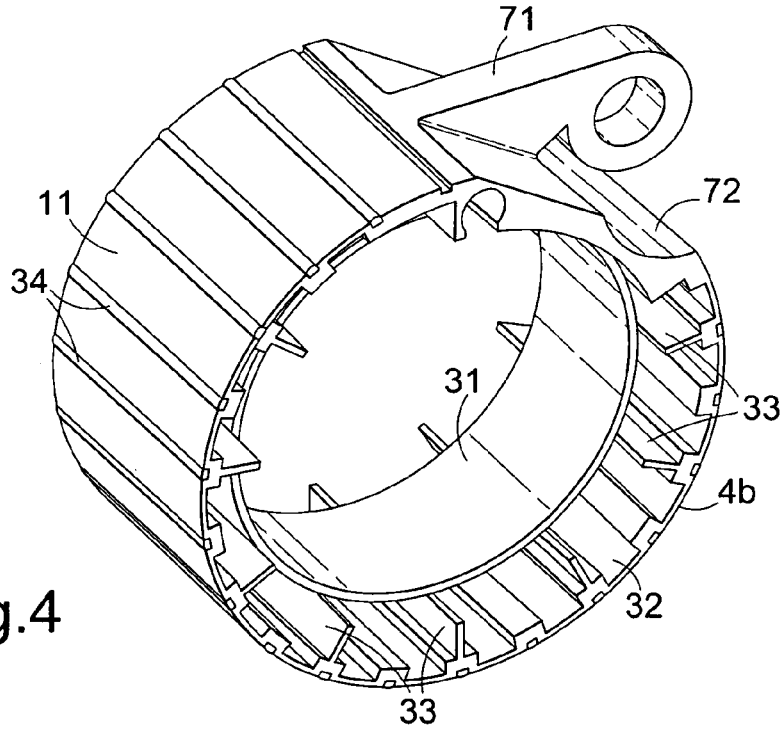
FIG. 4 is a perspective view of the outer part of the orbiting piston.
Figure 5:
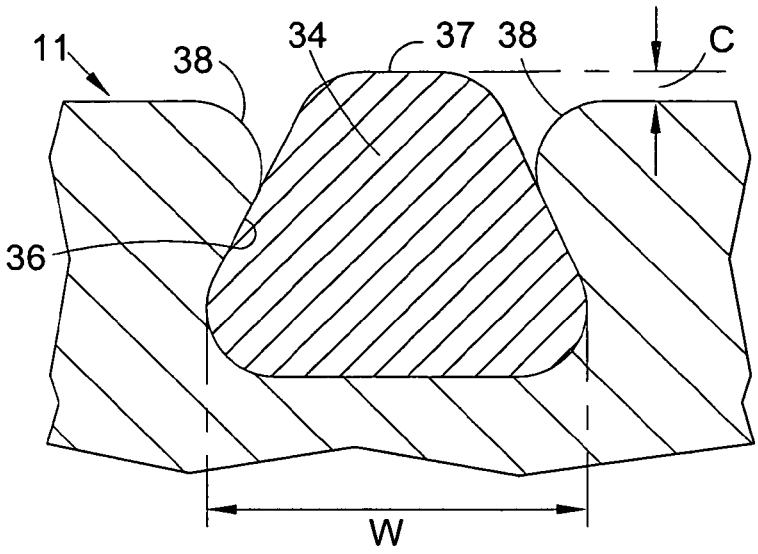
FIG. 5 is an enlarged cross-section through a compliant strip at the external surface of the orbiting piston.

The outer part 4*b* of the orbiting piston 4 (as best seen in FIG. 4) comprises an extruded body consisting of an inner shell 31 and an outer shell 32 connected by integral struts 33. The extruded body may be of light metal, e.g. an aluminum alloy.

The outer part 4*b* of the orbiting piston 4 is provided with a plurality of compliant strips 34 extending in the axial direction and being equally spaced apart. Each strip 34 is made of an elastomer, e.g. Viton or butyl rubber, and is mounted in a groove 36. The strip 34 narrows in a radially outward direction, having a cross-section which is a dovetail shape or, more precisely, a trapezium with round corners. The groove 36 widens in a radially inward direction and has a cross-sectional shape corresponding to that of the strip 34. The overall width W of the groove 36 is, for example, 4 mm. The strip 34 has a land 37 at a level at a distance C, preferably 0.2 mm or less (e.g. 0.1 mm), above the surface 11. The edges 38 of the groove 36 are chamfered, in particular rounded, so that the cross-sectional area of the groove 36 is equal to or greater than the cross-sectional area of the strip 34.

As the orbiting piston 4 orbits, the piston performs a rolling motion relative to the casing 1 and the strips 34 successively come into sliding contact with the internal surface 3 of the casing 1 and are compressed. There is at least one strip 34 in contact with the surface 3 over the majority of the orbit. For example, if the diameter of the surface 3 is 150 mm and the diameter of the surface 11 is 125 mm, the provision of about 18 strips 34 can ensure that two strips 34 are in contact with the surface 3 over the majority of the fluid compression or expansion phase. As the compliant strip 34 is compressed the displaced material is squeezed into the spaces left by the chamfered edges 38 of the groove 36 (more into the trailing space than the leading space). The number of cycles of compression which the strip 34 can withstand depends on the amount of free surface compared with the restrained or constrained surface and on the elastomer used.

Various modifications may be made within the scope of the invention. For instance, grooves of different cross-sectional shapes could be used. Similarly, compliant strips of different cross-sectional shapes may be used, e.g. rectangular, square, with a convex exposed face, or round. Compliant strips may be provided in the internal surface 3 of the casing 1 in the same way as the strips 34, instead of the strips 34, or in addition to the strips 34, in which case the two sets of strips are staggered relative to each other and it is possible to maintain three strips in sealing contact over the majority of the fluid compression or expansion phase.

Figure 6:
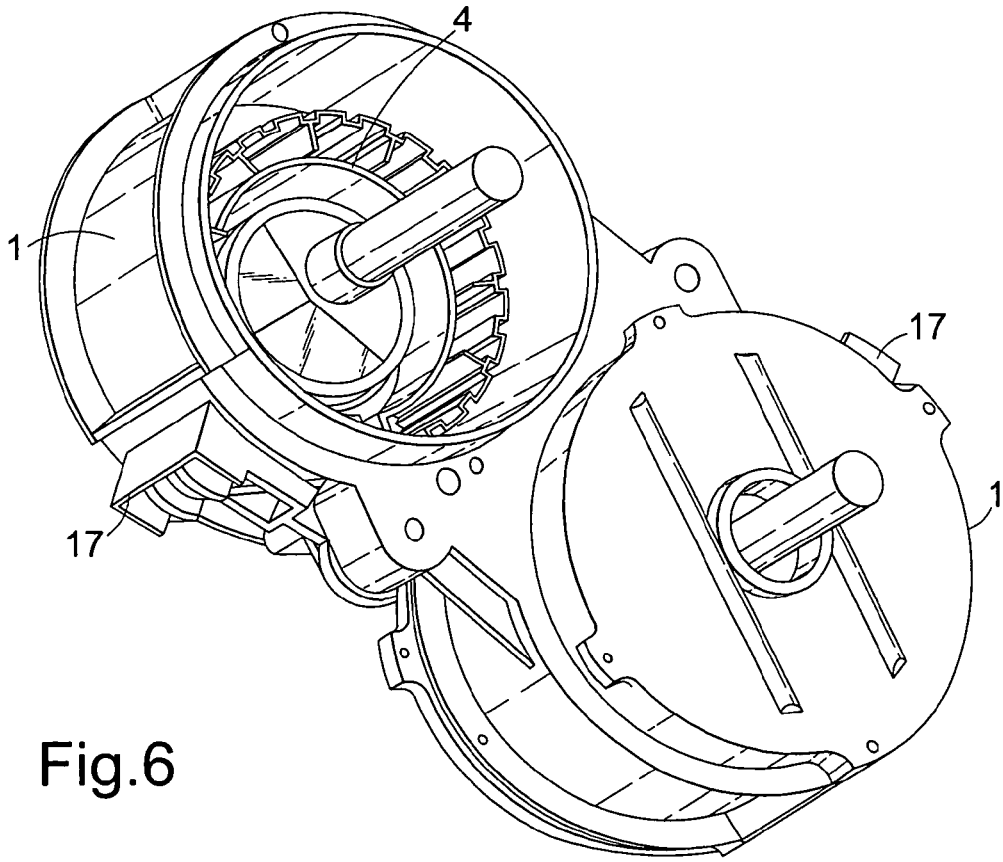
FIG. 6 is a perspective of an assembly of two machines, viewed from the drive side, with parts of one machine omitted.
Figure 7:
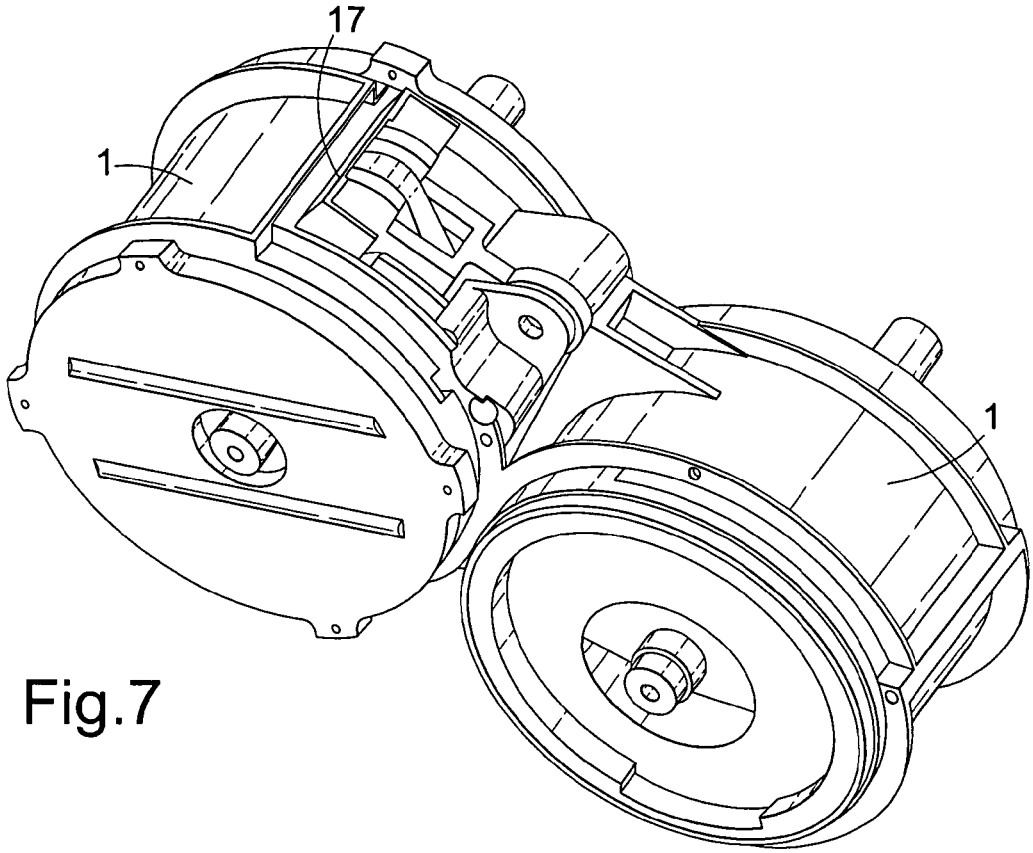
FIG. 7 is a perspective view of the assembly from the other side.

FIGS. 6 and 7 show two machines arranged in parallel, with their casings omitted. One machine may function as a compressor (e.g. a supercharger) and the other as an expander and/or compressor (e.g. a throttle-loss recovery machine). In this arrangement the reciprocating forces caused by the eccentric motions of the two machines can be balanced.

If two orbiting piston machines are fitted end-to-end and one is designed to balance the out-of-balance forces of the other, there will still be an out-of-balance couple. This can be substantially eliminated by fitting a counter-balance weight to the side of one machine remote from the other.

Where a compressor is used in a heat pump to compress a refrigerant in a heating or cooling cycle, a substantial amount of useful energy is lost as the refrigerant expands between the condenser and the evaporator. If orbiting piston machines as described above are used, a combination of an expansion turbine and a compressor fitted together can provide greater efficiency. The efficiency of a heat pump with a conventional compressor can be improved by linking an expansion turbine as described above with the compressor.

A refrigerant compressor as described above, but without rotating side discs, or another refrigerant compressor known in the art, may have a turbine as described above attached to it. The drive can be directly to the compressor or indirectly through the turbine.

Figure 8:
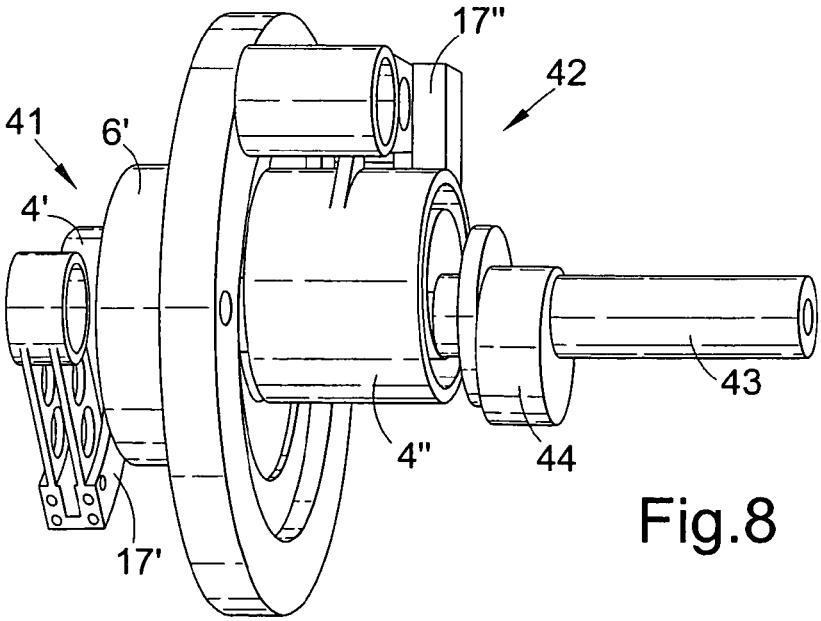
FIG. 8 is a perspective view of a turbine (expander) attached to a compressor, with outer casings removed.

FIG. 8 shows an expansion turbine 41 attached to a compressor 42 and having a common drive shaft 43. The outer casings have been removed. The turbine 41 is an orbiting piston machine of the type described above, with an orbiting piston $\mathbf{4}^1$, a vane member $\mathbf{17}^1$, and a single rotating side disc $\mathbf{6}^1$ (although it is also possible to use two side discs, one on each side of the orbiting piston $\mathbf{4}^1$). The compressor 42 also has an orbiting piston $\mathbf{4}^{11}$ and a vane member $\mathbf{17}^{11}$ but no rotating side discs (fluid inlet and outlet being through the casing). Alternatively, the compressor may be any known rotary compressor. A counter-balancing weight 44 is provided eccentrically on the shaft 43 to the side of the compressor 42 remote from the turbine 41.

Cooling in transportation vehicles has traditionally been through the use of a vapour-compression heat pump, with a hydrofluorocarbon as the working fluid. Poor maintenance of such systems results in significant proportions of the refrigerant leaking into the atmosphere.

Figure 9:
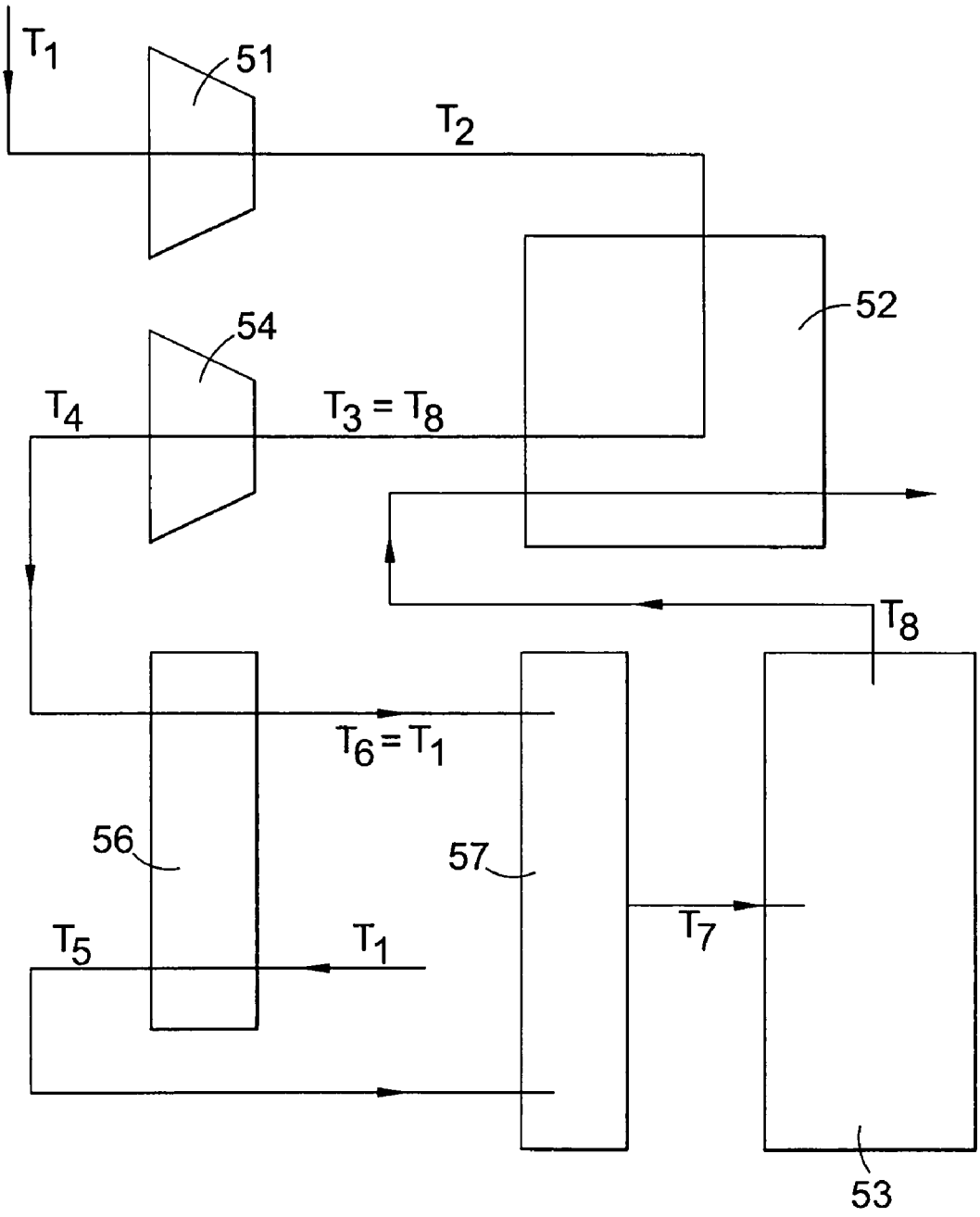
FIG. 9 is a diagram of a cooling/heating air cycle.

FIG. 9 shows a heating/cooling air cycle in which a compressor which is an orbiting piston machine and/or an expansion turbine which is an orbiting piston machine can advantageously be used.

In a cooling cycle, air at ambient temperature $T_1$ is compressed by a compressor 51 and leaves at an elevated temperature $T_2$. In a contra-flow heat exchanger 52 the air is cooled to a temperature $T_3$ approximately equal to the temperature $T_8$ of air extracted from a vehicle cabin 53. The air is then expanded in an expansion turbine 54 and leaves at a reduced temperature $T_4$. The expanded air is then passed through a second contra-flow heat exchanger 56 to cool incoming ambient air from $T_1$ to $T_5$ while the expanded air rises to a temperature $T_6$ approximately equal to $T_1$. The cooled ambient air and heated expanded air are selectively mixed in a mixer 57 to provide mixed air at a temperature $T_7$, which is passed to the vehicle cabin 53. Air at a temperature $T_8$ (which will normally be lower than $T_1$) is extracted from the cabin 53 and passed to the first heat exchanger 52 before being discharged to the atmosphere.

To heat the vehicle cabin air in cold weather, until the engine cooling water is hot enough, fresh ambient air or recycled air from the cabin 53 is passed through the first contra-flow exchanger 52 before being fed into the cabin 53.

The invention claimed is:

1. A rotary positive displacement machine comprising:

a casing having a circular cylindrical internal surface delimiting an operating chamber;

an orbiting piston in the operating chamber, the orbiting piston being mounted so as to orbit about a chamber axis which is the axis of the internal surface, the orbiting piston comprising a non-rotating outer part and a rotating inner part, the outer part having a circular cylindrical external surface, the chamber axis passing through the orbiting piston, a generatrix of the external surface being adjacent to the internal surface, and a diametrically opposite generatrix being spaced from the internal surface;

a vane member mounted on the casing, the vane member having a tip face which faces the external surface of the orbiting piston and which has a length substantially equal to that of the orbiting piston; and a linkage which connects the vane member to the orbiting piston so as to keep the tip face of the vane member adjacent the external surface of the orbiting piston;

wherein at least one of the external and internal surfaces is provided with individual compliant strips which are distributed around the one surface, run parallel to one another, and project above the one surface, from respective grooves in the one surface, the distribution of the compliant strips being such that there is at least one of the compliant strips in contact with the other surface over the majority of the orbit of the orbiting piston.

2. A machine as claimed in claim 1, in which each compliant strip narrows towards the other of the external and internal surfaces.

3. A machine as claimed in claim 1, in which each complaint strip has a land at a level above the one surface.

4. A machine as claimed in claim 1, in which each compliant strip is mounted in and protrudes from a groove which is wide beneath the one surface and the compliant strip is also wide beneath one surface.

5. A machine as claimed in claim 4, in which the edges of the groove are chamfered.

6. A machine as claimed in claim 4, in which the cross-sectional area of the groove is substantially equal to or greater than the cross-sectional area of the compliant strip.

7. A machine as claimed in claim 1, in which each compliant strip is made of an elastomer.

8. A machine as claimed in claim 1, in which only one of the external and internal surfaces is provided with the compliant strips.

9. A machine as claimed in claim 7, in which the one surface is the external surface of the orbiting piston.

10. A machine as claimed in claim 1, in which both of the external and internal surfaces are provided with the complaint strips.

11. A machine as claimed in claim 1, in which the outer part comprises an extruded body.

12. A machine as claimed in claim 1, including a disc at one end of the orbiting piston, the disc rotating about the chamber axis in synchronism with the orbiting piston and delimiting one end of the operating chamber.

13. An assembly comprising a first rotary positive displacement machine according to claim 1 and a second rotary positive displacement machine.

14. An assembly as claimed in claim 13, in which the two machines are fixed end-to-end and have a common axis.

15. An assembly as claimed in claim 13, in which the two machines are arranged side-by-side with parallel axes.

* * * * *